United States Patent [19]

Jackson et al.

[11] 3,938,716

[45] Feb. 17, 1976

[54] CONVERTIBLE BACK-PACK PANNIER

[76] Inventors: W. Shaun Jackson, 809 Sycamore, Ann Arbor, Mich. 48104; Leslie Eric Bohm, 29560 Rutherland, North, Southfield, Mich. 48076

[22] Filed: Sept. 18, 1974

[21] Appl. No.: 507,061

[52] U.S. Cl. ..... 224/9; 224/31

[51] Int. Cl.[2] ..... A45F 3/04

[58] Field of Search..... 224/8 R, 9, 30 R, 31, 32 R, 224/32 A, 39 R, 43, 44

[56] References Cited

FOREIGN PATENTS OR APPLICATIONS

| | | | |
|---|---|---|---|
| 104,694 | 6/1942 | Sweden | 224/30 |
| 1,052,572 | 1/1954 | France | 224/8 R |
| 81,599 | 3/1951 | Norway | 224/32 |
| 556,611 | 3/1956 | Italy | 224/30 |
| 149,560 | 5/1937 | Austria | 224/8 R |
| 1,238,303 | 7/1971 | United Kingdom | 224/9 |
| 203,581 | 6/1939 | Switzerland | 224/32 R |
| 230,388 | 12/1943 | Switzerland | 224/43 |

*Primary Examiner*—M. Henson Wood, Jr.
*Assistant Examiner*—John A. Pekar
*Attorney, Agent, or Firm*—Krass & Young

[57] ABSTRACT

A bag formed of sheet fabric material and adaptable for convertible use as either a pannier on a cycle or a backpack includes front and rear panel sheets having similar shapes and joined by a side panel. The bag has the form of an isosceles triangle, with a greater height than base, and with a truncated rounded apex. Part of the line of joinder of the side to the front panel is formed by a zipper extending along one side of the base to the rounded edge to provide access to the bag. A first webbing reinforcing strip is attached to the rear panel alongside its base edge. A second webbing reinforcing strip is attached to the rear panel, parallel to the base, between the side edges, a short distance from the rounded top. A pair of short straps are attached to the first reinforcing strip at spaced points and snap fasteners affixed to their secured and free ends allow the bag to be attached to the carrier of a cycle so that the base edge of the bag is aligned with the carrier and the bag projects downwardly with its rear sides along the wheel of the cycle. A pair of wire rings attached to the second reinforcing strip at spaced points are adapted to secure back-pack straps so that the bag may be carried with its top between the shoulders of a wearer with the rear panel adjacent the back and the base edge forming the bottom.

12 Claims, 8 Drawing Figures

CONVERTIBLE BACK-PACK PANNIER

BACKGROUND OF THE INVENTION

1. Field of the Invention

This invention relates to bags suitable for carrying small articles and more particularly to a bag configured for convertible use as either a pannier on a cycle or as a back-pack.

2. Prior Art

A variety of forms of bags termed panniers are available for attachment to horizontal carriers fixed over the rear wheel of a bicycle to extend downwardly, alongside the wheel. These bags vary form one another in their convenience in loading and unloading, difficulty in attachment to the vehicle, capacity, the manner in which they impose a load on the vehicle, and other factors. One object of the invention is to provide a pannier which may be easily attached and detached from a bicycle; is easy to load and unload; has a relatively high load-carrying capacity; and distributes that load in such a manner as to avoid imposing unbalanced or high center of gravity loads on the bicycle.

The desirability of a pannier being convertible for use as a back-pack is apparent. For example, a student can ride a bike to school with books in the bag in its pannier mode and then carry the books on his back in the back-pack. Similarly, a back-packer can ride to a remote location on a bicycle and then convert the pannier to back-pack use. However, the configuration of a back-pack is as critical as a pannier's configuration in terms of its functional characteristics. Accordingly, it is another object of the present invention to provide a pannier which aptly serves the dual function of an improved back-pack as well.

SUMMARY OF THE INVENTION

The present invention relates to a bag having a unique configuration which makes it particularly well-adapted for use as a pannier; equally well-adapted for use as a backpack; and readily convertible between these alternative uses. The bag of the present invention is primarily adapted for two such divergent uses because of its unique shape. The front and rear panels of the bag are formed similarly with a straight edge and a pair of substantially straight side edges intersecting the base at equal and opposite acute angles of approximately 75°. The ends of the straight side edges are joined by a curved edge symmetrical with respect to the base. The shape may be described as an isosceles triangle having a gently rounded apex and a height dimension substantially in excess of its base dimension. Alternatively, it might be described as a tear-drop shape with a flattened edge.

When used on a cycle, the flat base is attached to a horizontal rear wheel carrier to extend parallel to the carrier and the rounded edge extends downwardly alongside the wheel. The bag is aligned so that its inclined forward side clears the brace member extending at an inclined angle from the seat of the bike to the rear axle and provides clear wheel path for the pedaling action.

The tear-drop shape of the bag eliminates the two lower corners, thereby minimizing the possibility of the edges of the bag protruding between the spokes of the rear wheel of a cycle since there are no elongated sharp edges at the lower ends.

In this position the center of gravity of the bag will be only slightly to the rear of a vertical line through the rear axle so that only relatively minor moments will be exerted by the bag and its contents about the rear axle. The center of gravity of the bag will also be located only slightly above the rear axle. Thus, even when fully loaded, the bag of the invention will not produce forces which substantially unbalance the bike.

When used as a back-pack, the bag is adapted to be supported with its narrow rounded edge between the shoulders of the packer and with the base edge at the bottom, close to the hips of the wearer. This is a very comfortable position with the packer having full freedom of motion of shouldlers and arms and the center of gravity of the bag is comfortably low on the back to impose a minimum of rearwardly twisting forces on the shoulders. Should the bag be used as a back-pack while riding a bicycle, the tear-drop shape also allows the cyclist more rearward vision looking back over his shoulder.

A padding member formed of a thin sheet of plastic foam material is adhered to the interior of the back panel and acts to both cushion the back of the wearer against the sharp edges of any contents and additionally stiffen the bag portion so as to eliminate the possibility of a loose edge protruding into the wheels of the cycle.

So that the bag may be readily converted into back-pack use, the rear panel of the bag — the one that is in contact with the side of the bicycle and the back of the packer — if formed with a pair of woven webbing reinforcing strips, one extending along the base edge, and the other extending parallel to the base, between the straight sides of the bag, slightly displaced from the rounded edge of the bag. A pair of short straps are affixed to the base webbing slightly inwardly from the two opposed edges. These straps have two-part snap fasteners connected at their free ends and at their points of joinder to the base so that the free ends can be joined to the base section to form short loops adapted to wrap around the bars of a bicycle carrier. The snap fasteners are of the "pull-the-dot" type which can only be opened by initially separating the side of the snap adjacent to the end of the strap, so that the fasteners are highly resistant to accidental opening when in use. Wire D-rings are attached to the extreme ends of the base reinforcing webbing and to a pair of displaced points on the reinforcing strip at the other end of the bag and conventional back-pack straps may be readily joined to these loops with clip fasteners.

A zipper extending along the joinder of the front panel to the side panel, from the middle of the base to the middle of the curved end, allows easy access to the interior of the bag without disturbing the contents of the bag.

Wire D-rings are attached to the front panel at a pair of spaced points along the base by short webbing loops. These rings serve numerous useful functions, including: allowing a pair of the bags to be joined together to form a double back-pack; providing a packer means for suspending from the pannier such items as a sleeping bag or camera tripod, as well as another pannier; and providing means for a cyclist to fasten additional gear on the top of the pannier using the D-rings as fasteneing points. They also allow a cyclist to compress the load in the pannier closer to the rear wheel of the bicycle to enhance its stability, by pulling the D-rings toward the carrier.

Other objectives, advantages and applications of the present invention will be made apparent by the following detailed description of a preferred embodiment of the invention. The description makes reference to the accompanying drawings in which.

Figure 1:
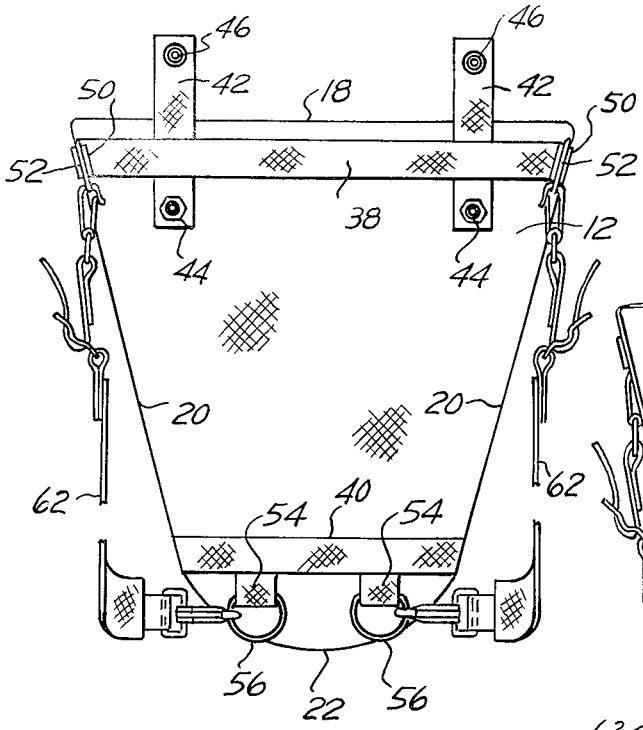
FIG. 1 is a view of the bag forming the preferred embodiment of the invention from the back panel.
Figure 2:
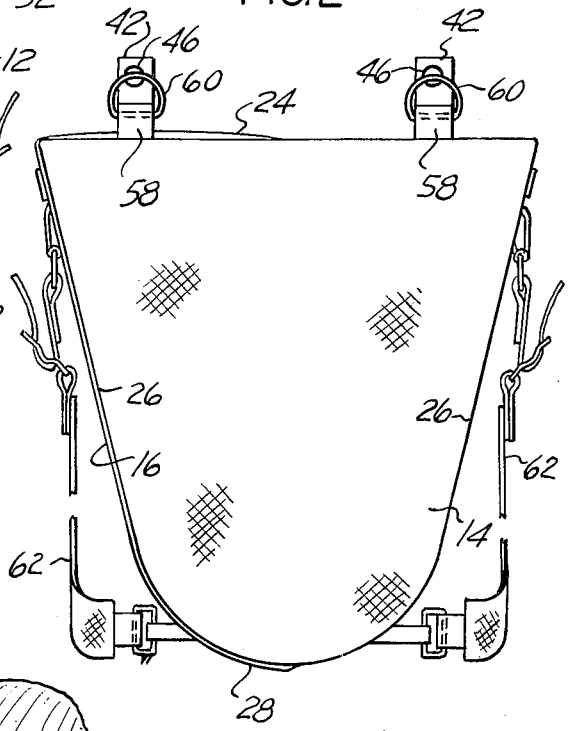
FIG. 2 is a view of the bag from the front panel.

Referring to the drawings, a bag forming the preferred embodiment of the invention is preferably constructed of a waterproofed synthetic fabric material. The bag is primarily formed by similarly shaped rear 12 and front 14 panels joined together by a side panel 16 which runs about the full perimeter of the front and rear panels and joins the two together.

The rear panel 12 has a flattened tear-drop shape, or the shape of an isosceles triangle with a rounded truncated apex. It has a flat base edge 18 and a pair of side edges 20 which intersect the base edge at equal and opposed angles of approximately 70° to 75°. The opposite ends of the sides 20 are joined preferably by a rounded section 22, although the sides 20 could form an apex or be truncated. The dimension of the bag along the line normal to the base 18 and intersecting the center of the rounded section 22 will be somewhat longer than the base. In a preferred embodiment the base has a length of about 14 inches and the length of the line normal to the base, intersecting the center of the rounded section 22, is about 15.

The front panel 14 has a similar shape, having a first base 24, a pair of side edges 26 and a rounded top edge 28.

In alternative embodiments of the invention, the edges 20 need not be straight but might be somewhat rounded and the proportions of the base to the height might vary but it is important that the height of the bag be at least equal and preferably exceed the dimension of the base.

Figure 3:
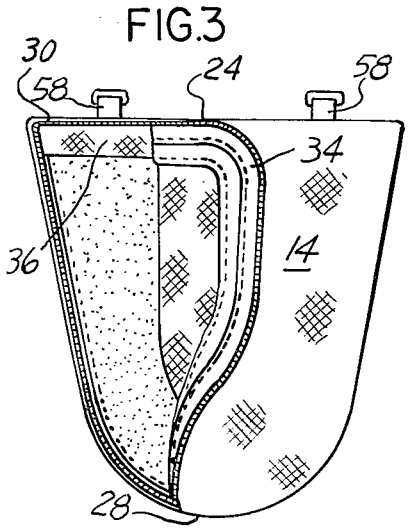
FIG. 3 is a view from the front panel with the bag opened.

Access to the bag is had through a zippered closure formed along one edge of the bag from the center of the base 24 to the center of the rounded section 28. The entire half of the front section of the bag may be lifted away, as shown in FIG. 3. One section of the zipper 30 is attached to the perimeter of the side of the bag, while the other section of the zipper 32 is attached to a flap 34 extending beneath the lift-away section of the top 14.

The interior of the bag is equipped with a resilient sheet panel 36 having the shape of, and secured to, the inner-side of the rear of the bag. This panel acts as a cushion for the contents of the bag and to stiffen the bag. Alternatively, the cushion 36 may be disposable in a pocket associated with the interior of the rear panel so as to be removable therefrom.

A first section of nylon webbing 38 is stitched to the rear panel 12 parallel to and slightly displaced from the base edge 18. A second section of reinforcing webbing strip 40 is similarly secured between the edges 20, parallel to the base 18 and slightly displaced from the rounded edge 22.

A pair of short nylon webbing straps 42 are sewn to the bag under the reinforcing strips 38 so that their free ends extend normally to the length of the strip 38. The straps 42 are spaced slightly inwardly from the opposite ends of the strips 38. The ends of the straps 42 that are sewn to the bag carry male snap fastener member 44 and the free ends of the strips 42 carry complementary female snap fastener members 46. The female members may be attached to the male members to form short loops adapted to engage the ends of a rear wheel carrier 48 of a bicycle, as shown in FIG. 4.

Figure 6:
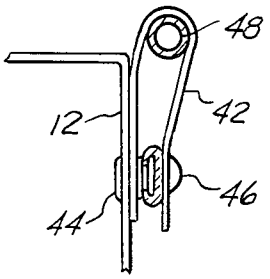
FIG. 6 is a cross sectional view taken along line 6—6 showing a snap fastener retaining the bag to the carrier of a bike.
Figure 7:
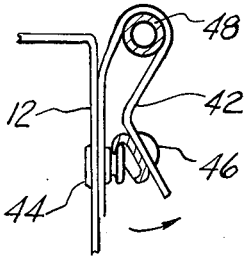
FIG. 7 is the cross-sectional view shown in FIG. 6 illustrating the dynamics of the snap fastener.

Referring to FIGS. 6 and 7, the snap fasteners 44, 46 are preferably of the "pull-the-dot" type which may only join to one another and be separated from one another by a pivoting motion of the female member 46 with respect to the male member 44. That is, to separate the female member 46 from the male member 44 it is necessary to provide a lifting force at the bottom of the female member as shown in FIG. 7. A force on the entire female member that tends to pull it normally away from the male member will not separate the two. Thus, as can be seen, forces exerted by the carrier 48 through the strap 42 tending to pull the top of the female member 46 from the male member 44 will not succeed in opening the snap.

Figure 8:
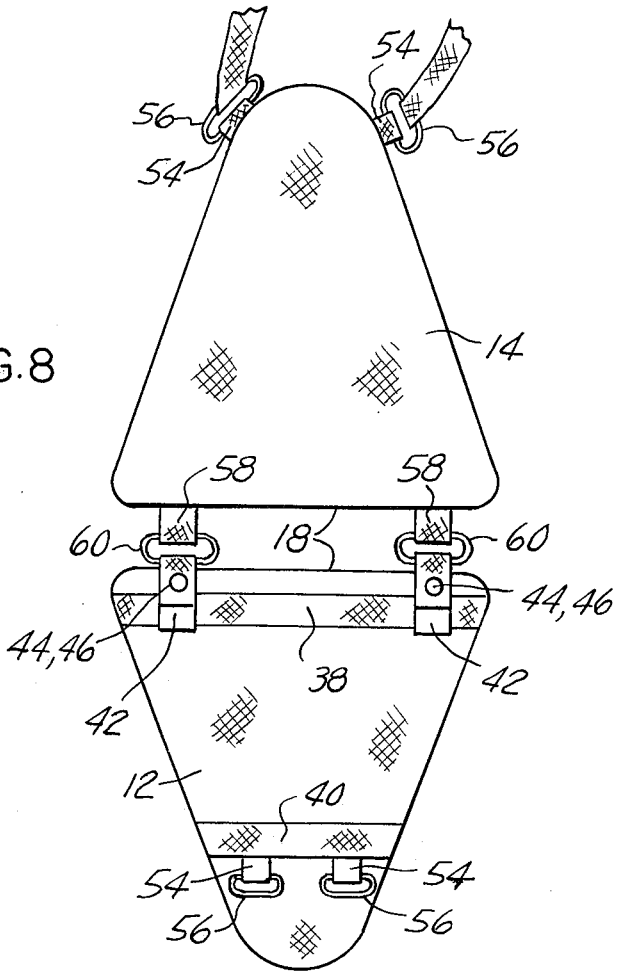
FIG. 8 is an illustration of two of the bags joined together to form a double back-pack.

Short webbing loops 50 attached to and extending outwardly from the extreme ends of the reinforcing strip 38 retain wire D-rings 52 used to affix back-pack straps as will be subsequently described. A similar pair of webbing loops 54 have their ends affixed under a second reinforcing strip 40 adjacent to the top of the bag and they project toward the rounded end 22, normally to the reinforcing strip 40. These loops 54 also retain a pair of wire D-rings 56 useful for attaching back-pack straps to the bag. A third set of short reinforcing loops 58 are attached to the base edge 24 of the front panel 14 of the bag slightly inwardly from the side edges thereof. These loops retain a pair of wire D-rings 60 at their free end which constitute lashing points useful for attaching objects to be carried externally of the bag, such as sleeping bag rolls, to the bag. These lashing points 60 are also useful for joining a pair of the inventive bags together for the purpose of forming a double bag back-pack. Referring to FIG. 8, this is accomplished by positioning the bags so their base edges 18 abut one another, and inverting one of the bags so that the straps 42 fastened to the backside 12 of the inverted bag will join with the wire D-rings 60 retained by the loops 58 attached to the front side 14 of the other bag.

Figure 4:
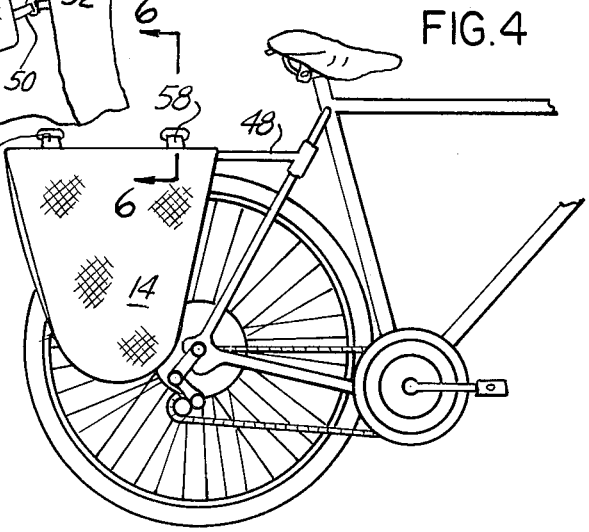
FIG. 4 shows the manner of attachment of the bag to the carrier of a bicycle.

As seen in FIG. 4, when the bag is attached to a bicycle by securing the straps 42 about spaced sections in the carrier 48 of the cycle and securing fastener members 44 and 46 together, the rounded edges 22, 28 project downwardly and the rear side 12 of the bag is disposed alonside the wheel. The weight of the contents of the bag retain it in the proper orientation. The inclined sides of the bag allow clearance for the heel path of the rider while pedaling, yet the center of gravity of the bag is only slightly displaced to the rear of a vertical line through the rear axle of the bicycle. The relatively slight moment thus imposed about the rear axle is to be contrasted with the much larger moment which would be provided with a conventional rectangular pannier of the type which has one sloped edge to clear the heel path of the rider. The downwardly sloped shape tends to cause heavier objects in the bag to gravitate toward the bottom, thus lowering the center of gravity of the contents.

Figure 5:
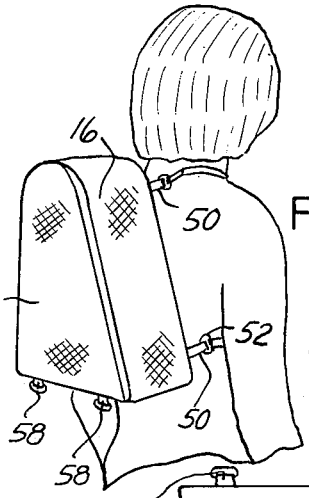
FIG. 5 illustrates the bag used as a back-pack.

A pair of conventional shoulder straps 62 may be attached to the D-rings 52 and 56 by appropriate snap fasteners to readily convert the bag to back-pack use. As seen in FIG. 5, the bag is worn with the narrow rounded upper edge between the shoulder blades of the wearer freeing the shoulders for motion and imposing the primary weight at the base end of the bag adjacent to the hips of the packer. Again, this minimizes the unbalanced forces exerted about the central axis of the wearer's back, as well as allowing a cyclist unhampered rearward vision should the pannier be used as a back-pack while cycling.

It is thus seen that the bag of the present invention is particularly well adapted for use as a pannier; equally well adapted for use as a back-pack; and is readily convertible between the two uses. This convenient convertability arises by virtue of the shape of the bag and its closure formation and manner of attachment to the fastener points.

The embodiments of the invention in which an exclusive property or privilege is claimed are defined as follows:

1. A bag adapted to be attached to the rear wheel carrier of a cycle for use as a pannier or convertibly used as a back-pack, comprising: first and second fabric sections, each having a straight base edge and a pair of substantially straight side edges forming substantially equal and opposed acute angles with the base so that the side edges are directed toward one another in a direction away from the base and are joined to one another at their ends opposite to the base; a side panel extending fully about the perimeters of said two sections and joining the sections together in spaced relationship to one another so as to enclose a volume; separable closure means providing access to the interior of the volume of the bag; first fastener means secured to the second section adjacent to the bass edge and adapted to fasten to the carrier of a cycle so that the base edge extends parallel to the carrier and the bag extends downwardly therefrom; and second fastener means affixed to the second section adjacent the base and the end opposite the base and adapted to secure back-pack straps to the bag so that the bag may be attached to and supported on the back of a wearer with the base projecting downwardly.

2. The bag of claim 1 wherein the separable closure means providing access to the interior of the volume of the bag, extends along one edge of the first section between the center of the base and the end of said edge opposite the base.

3. The bag of claim 1 wherein the substantially equal and opposed acute angles formed between the side edges and the bases of the section are greater than 45° so that the dimension of the bag perpendicular to the base exceeds the length of the base.

4. The bag of claim 1 including a first reinforcing strip attached to said second section so as to extend along the base edge and reinforce said first fastener means and a second reinforcing strip attached to said second section parallel to the base and adjacent to the end opposite the base reinforcing said second fastener means.

5. A bag adapted to be attached to the rear wheel carrier of the bicycle for use as a pannier or alternatively used as a back-pack, comprising: front and rear sheet panels, each having a similar outline which includes a straight base edge, a pair of substantially straight edges intersecting the base edge at equal and opposite acute angles so that the side edges converge toward one another in a direction away from the base edge, and a rounded top edge joining the side edges at their ends opposite to the base edge; a side panel having a pair of parallel edges, one attached to the perimeter of the front panel and the other attached to the perimeter of the rear panel so as to join the panels to form an enclosed bag; a separable fastener member forming a portion of the line of attachment of the side panel to the front panel to provide access to the interoior of the bag; a pair of first fastener members attached to the bag at a pair of spaced points, each located adjacent to the joinder of the base line of the rear panel to the side panel and adapted to be attached to the carrier of a bicycle so as to support the bag with the rear panel in proximity to the side of the bicycle, with the base aligned with the carrier and the rounded top edge projecting downwardly therefrom; and second and third fastener means attached to the base and top of the rear panel of the bag respectively, adapted to secure back-pack straps to the bag so that the bag may be retained with the rear panel adjacent to the back of a packer with the rounded top edge supported between the shoulders of the packer and the bag projecting downwardly therefrom.

6. The bag of claim 5 wherein the first fastener means adapted to retain the bag to the carrier of a bicycle consists of a pair of straps each having one end affixed to the bag, and separable closure means attached to the free end of each strap and to the bag.

7. The bag of claim 5 wherein the equal and opposite acute angles formed between the straight side edges and the bases exceed 45° so that the dimension of the bag in a direction normally to the base exceeds the length of the base.

8. A bag adapted to be attached to the rear wheel carrier of a cycle for use as a pannier or convertibly used as a back-pack, comprising: front and rear sheet panels having similar shapes, each taking the form of an isosceles triangle having a truncated rounded apex with the height of the triangle exceeding the length of the base; a side panel having a pair of parallel edges, one attached to the perimeter of the rear panel and one attached to the perimeter of the front panel so as to join the panels to form an enclosed bag; a pair of first fastener members attached to the bag at a pair of spaced points, each located adjacent to the joinder of the base line of the rear panel to the side panel and adapted to be attached to the carrier of a bicycle so as to support the bag with the rear panel in proximity to the side of the bicycle, the base aligned with the carrier and the rounded apex projecting downwardly therefrom; and fastener means attached to the bag adjacent to the base and apex of the rear panel, adapted to secure back-pack straps to the bag so that the bag may be retained with the rear panel adjacent to the back of a packer with the rounded apex supported between the shoulders of the packer and the bag projecting downwardly therefrom.

9. The bag of claim 8 including a zipper fastener extending along the line of attachment of the front panel to the side panel between a point at about the middle of the base to a point at about the center of the rounded apex, so as to provide access to the bag.

10. The bag of claim 8 further including a first reinforcing strip attached to the rear of the bag adjacent to and along the length of the base and a second reinforcing strip attached to the rear of the bag parallel to the first strip, between the side panels, adjacent to the rounded apex of the bag.

11. The bag of claim 8 further including a resilient sheet having substantially the dimensions of the back panel affixed to the interior side of the back panel within the bag.

12. A bag adapted to be attached to the rear wheel carrier of a cycle for use as a pannier or convertibly as a back-pack, comprising: front and rear sheet panels having similar shapes, each having the form of an isosceles triangle with a truncated rounded apex with the height of the triangle exceeding the length of the base; a side panel having a pair of parallel edges, one attached to the perimeter of the rear panel and one attached to the perimeter of the front panel to join the panels to form an enclosed bag; a first reinforcing strip attached to the rear of the bag adjacent to and along the length of the base; a second reinforcing strip attached to the rear of the bag parallel to the first strip, between the side panels, adjacent to the rounded apex of the bag; a pair of first fastener members attached to the first reinforcing strip at a pair of spaced points and adapted to be attached to the carrier of a cycle to support the bag with the rear panel in proximity to the side of the bicycle, the base aligned with the carrier and the rounded apex projecting downwardly therefrom; second fastener means attached to the first and second reinforcing strips; and a pair of elongated adjustable back-pack straps having fastener mean formed on their free ends attachable to said second fastener means so that said bag may be used as a back-pack with the apex between the shoulders of the wearer and the base extending downwardly.

* * * * *

UNITED STATES PATENT OFFICE

CERTIFICATE OF CORRECTION

Patent No. 3,938,716 Dated February 17, 1976

Inventor(s) W. Shaun Jackson and Leslie Eric Bohm

It is certified that error appears in the above-identified patent and that said Letters Patent are hereby corrected as shown below:

Column 3, line 43 "first" should be --flat--;
Column 4, line 60 "alonside" should be --alongside--;
Column 5, line 43 "bass" should be --base--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*